US011530125B2

(12) United States Patent
Steen

(10) Patent No.: US 11,530,125 B2
(45) Date of Patent: Dec. 20, 2022

(54) CONTAINER

(71) Applicant: STEEN PRODUCTS, INC., Fort Mill, SC (US)

(72) Inventor: Robby Wayne Steen, Fort Mill, SC (US)

(73) Assignee: STEEN PRODUCTS, INC., Fort Mill, SC (US)

( * ) Notice: Subject to any disclaimer, the term of this patent is extended or adjusted under 35 U.S.C. 154(b) by 72 days.

(21) Appl. No.: 17/150,664

(22) Filed: Jan. 15, 2021

(65) Prior Publication Data

US 2022/0017345 A1 Jan. 20, 2022

Related U.S. Application Data

(63) Continuation-in-part of application No. 16/998,234, filed on Aug. 20, 2020.

(Continued)

(51) Int. Cl.

| | |
|---|---|
| ***B67C 11/02*** | (2006.01) |
| ***B65D 25/42*** | (2006.01) |
| *B65D 69/00* | (2006.01) |

(52) U.S. Cl.

CPC ..... *B67C 11/02* (2013.01); *B65D 25/42* (2013.01); *B65D 69/00* (2013.01)

(58) Field of Classification Search

CPC ..... B65D 47/2043; B65D 47/2031; B65D 47/2012; B65D 47/2006; B65D 47/16; B65D 5/746; B65D 5/745; B65D 5/743; B65D 5/742; B65D 5/74; B65D 25/40; B65D 25/38; B65D 25/42; B65D 69/00; B65D 23/12; B67C 11/02

See application file for complete search history.

(56) References Cited

U.S. PATENT DOCUMENTS

| | | | |
|---|---|---|---|
| 4,236,655 | A | 12/1980 | Humphries |
| 4,243,162 | A | 1/1981 | Klygis |

(Continued)

FOREIGN PATENT DOCUMENTS

| | | | |
|---|---|---|---|
| DE | 3032184 | A1 | 4/1982 |
| DE | 202005006134 | U1 | 7/2005 |
| EP | 3816062 | A1 | 5/2021 |

OTHER PUBLICATIONS

PCT International Search Report and Written Opinion cited in International Application No. PCTUS2021027262; dated Jul. 20, 2021; 10 pages.

(Continued)

*Primary Examiner* — Kareen K Thomas

(74) *Attorney, Agent, or Firm* — Shumaker, Loop & Kendrick, LLP; S. Alexander Long, Jr.

(57) ABSTRACT

A container that includes a container body adapted for containing a flowable material for storage and dispensing through a dispensing opening in the container body. A funnel is positioned in a stowage location in the container body and is adapted to be removed from the stowage location and moved to a flowable material-receiving location physically-separate from and proximate to the dispensing opening in the container body. A wiping sheet is positioned with the funnel in the stowage location and adapted to be removed from the stowage location and used to wipe and absorb the flowable material.

15 Claims, 20 Drawing Sheets

Related U.S. Application Data

(60) Provisional application No. 63/053,341, filed on Jul. 17, 2020.

(56) References Cited

U.S. PATENT DOCUMENTS

| | | | | |
|---|---|---|---|---|
| 4,488,584 | A | 12/1984 | Hestehave et al. | |
| 4,583,668 | A | 4/1986 | Maynard, Jr. | |
| 4,901,878 | A | 2/1990 | Humphries | |
| D307,547 | S | 5/1990 | Humphries | |
| 5,101,870 | A * | 4/1992 | Farris | B65D 1/02 215/390 |
| 5,400,928 | A | 3/1995 | Resnick | |
| 5,454,483 | A | 10/1995 | Ichikawa et al. | |
| D414,115 | S | 9/1999 | Goettner | |
| 7,048,150 | B2 | 5/2006 | Barnett et al. | |
| 8,118,198 | B1 | 2/2012 | Watson | |
| D696,127 | S | 12/2013 | Juna | |
| 9,365,320 | B1 * | 6/2016 | Erickson | B23P 17/00 |
| D762,120 | S | 7/2016 | Valentine | |
| D762,477 | S | 8/2016 | Valentine | |
| 9,439,551 | B1 * | 9/2016 | Atkinson | B05B 15/30 |
| D790,970 | S | 7/2017 | Bos | |
| D790,971 | S | 7/2017 | Bos | |
| 9,783,339 | B1 | 10/2017 | Atkinson et al. | |
| D813,679 | S | 3/2018 | Bos | |
| 10,059,501 | B2 * | 8/2018 | Bogenrief | B65D 81/18 |
| 10,124,930 | B2 | 11/2018 | Sessions | |
| D835,991 | S | 12/2018 | Veldhuis | |
| D857,508 | S | 8/2019 | Uetsuki | |
| D888,197 | S | 6/2020 | McDonnell | |
| 10,822,147 | B2 | 11/2020 | Bongiovanni | |
| 2001/0030203 | A1 * | 10/2001 | Weber | B05B 11/0037 222/464.7 |
| 2006/0186144 | A1 * | 8/2006 | Tinsley | B05B 15/30 222/464.7 |
| 2009/0008414 | A1 * | 1/2009 | Tingsley | B05B 11/0059 222/464.7 |
| 2009/0107582 | A1 * | 4/2009 | Sayage | B65D 51/24 141/340 |

OTHER PUBLICATIONS

PCT International Search Report and Written Opinion cited in International Application No. PCTUS2020049916; dated Nov. 20, 2020; 9 pages.

* cited by examiner

CONTAINER

PRIORITY CLAIM

This utility patent application claims priority from U.S. Provisional Patent Application No. 63/053,341, filed on Jul. 17, 2020, and U.S. Utility patent application Ser. No. 16/998,234, filed on Aug. 20, 2020, the contents of which are incorporated by reference in this application.

TECHNICAL FIELD AND BACKGROUND OF THE INVENTION

This invention relates to containers of a type particularly suited to contain flowable materials such as motor oil, brake and transmission fluids and similar flowable material products used in in transportation, such as motor vehicles, aircraft, as well as construction and mining equipment and the like. In many instances, replenishment of such flowable materials can result in spillage due to the small size of filler tubes into which the flowable materials must be poured. Funnels can be used, but because they are not part of or associated with the container, they may not be available when needed, or even if available, not used as intended. The result can be wasted product and contamination of the area surrounding where the products are dispensed from the container.

In many cases spilled contents cannot be quickly removed due to lack of readily available materials, for example, paper wipes, with which the spilled contents can be wiped up and the paper wipe properly disposed of A user's hands may also become into to contact with the product from the container, requiring a hand wipe for cleaning the hands which then should be properly disposed of.

HDPE is the most widely used resin for plastic containers of the type that is the subject of this application. This material is economical, impact resistant, and provides a good moisture barrier. HDPE is compatible with a wide range of products including oils, acids and caustics. However, the novel container disclosed in this application is not limited to any specific material or any specific end use but can be used in any environment including medical, food service, military, agricultural, industrial and other end uses based on selection of the appropriate plastic material, size, wall thickness and other factors. Materials other than HDPE can, without limitation, include Fluorine-treated HDPE, Low-density polyethylene (LDPE), Polyethylene terephthalate (PET, PETE)/Polyester, Polycarbonate (PC), Polypropylene (PP), Polystyrene (PS), Polyvinyl chloride (PVC), Post-consumer resin (PCR).

PCR is a blend of reclaimed natural HDPE (primarily from milk and water containers) and virgin resin. The recycled material is cleaned, ground and re-compounded into uniform pellets along with prime virgin material especially designed to build up environmental stress crack resistance. Other suitable materials include K-Resin (SBC), Bioplastic, and Bisphenol A (BPA).

BPA is a synthetic compound that serves as a raw material in the manufacturing of such plastics as polycarbonates and epoxy resins. It is commonly found in reusable drink containers, food storage containers, canned foods, children's toys and cash register receipts. Many of these materials lend themselves to be recycled and fabricated into various post-consumer products.

SUMMARY OF THE INVENTION

It is therefore an aspect of the present invention to provide a container that includes a funnel to facilitate pouring of contents from the container without spillage.

It is another aspect of the present invention to provide a container that is usable in a wide range of applications.

It is another aspect of the present invention to provide a container that includes a funnel that is stowable with and separable from the body of the container.

It is another aspect of the present invention to provide a container that includes a funnel that in a stowage location fits within the overall area occupied by the body of the container.

It is another aspect of the present invention to provide a container that includes a funnel that is deployable for use and stowable with the container for later use.

It is another aspect of the present invention to provide a container that is reusable and easily recyclable.

It is another aspect of the invention to provide a container that includes a sheet of material stowed with the container and which is suitable for wiping up any spilled contents of the container for proper disposal.

It is another aspect of the invention to provide a container that includes a funnel and a sheet of material stowed with the container.

It is another aspect of the invention to provide a container that includes a funnel within which a sheet of material is positioned with the container.

These and other aspects and advantages of the invention are achieved by providing a container that includes a container body adapted for containing a flowable material for storage and dispensing through a dispensing opening in the container body. A funnel is positioned in a stowage location on the container body and adapted to be removed from the stowage location and moved to a flowable material-receiving location physically-separate from and proximate to the dispensing opening in or on the container body. A wiping sheet is positioned with the funnel in the stowage location and adapted to be removed from the stowage location and used to wipe and absorb the flowable material.

According to a further aspect of the invention, the wiping sheet in the stowage location with the funnel is in a folded configuration.

According to a further aspect of the invention, the funnel includes an interior volume and the wiping sheet is positioned in the interior volume of the funnel when the funnel is positioned in the stowage location.

According to a further aspect of the invention, the stowage location is a recess formed in a side wall of the container.

According to a further aspect of the invention, the stowage location is a cavity formed in a bottom of the container.

According to a further aspect of the invention, the funnel is formed of a sheet material having a relatively large top opening and a spaced-apart, relatively small bottom opening.

According to a further aspect of the invention, the funnel is formed of a plastic material having a relatively large top opening and a spaced-apart, relatively small bottom opening and with an exterior configuration corresponding to the configuration of the cavity.

According to a further aspect of the invention, the funnel is polygonal in lateral cross-section.

According to a further aspect of the invention, the recess occupies at least 50 percent of an area of the side wall.

According to a further aspect of the invention, a cover is adhered to the bottom of the container and overlying the cavity.

According to a further aspect of the invention, a container is provided that includes a container body adapted for containing a flowable material for storage and dispensing through a dispensing opening in the container body. A funnel stowage location on the container is provided, defined by a funnel-shaped cavity formed in a bottom of the container body with a funnel positioned in the cavity and adapted to be removed from the stowage location and moved to a flowable material-receiving location physically separate from and proximate to the dispensing opening in the container body. A wiping sheet is positioned with the funnel in the cavity and adapted to be removed from the cavity and used to wipe and absorb the flowable material. A cover is adhered to the bottom of the container and overlying the cavity.

According to a further aspect of the invention, the wiping sheet is folded and positioned in the cavity overlying the funnel.

According to a further aspect of the invention, the funnel is plastic and defines a polygon in lateral cross-section.

According to a further aspect of the invention, the funnel includes a side wall extending between a relatively large top opening and a relatively small bottom opening, wherein the side wall defines a concave curve.

According to a further aspect of the invention a container is provided that includes a container body adapted for containing a flowable material for storage and dispensing through a dispensing opening in the container body, including a wall extending between the dispensing opening and a bottom of the container body and defining a funnel stowage location. Top and bottom physical attachments are provided for releasably securing a funnel to the funnel stowage location. The funnel is adapted to be removed from the funnel stowage location and moved to a flowable material-receiving location physically separate from and proximate to the dispensing opening in the container body, and a wiping sheet is positioned in the funnel and adapted to be removed from the funnel and used to wipe and absorb the flowable material.

According to a further aspect of the invention, the top physical attachment includes a loop carried by the funnel proximate the top opening of the funnel and adapted to extend over the dispensing opening in the container body and retain the top opening of the funnel against the funnel stowage location.

According to a further aspect of the invention, the bottom physical attachment is a seat formed in the wall of the container body proximate the bottom opening of the funnel and shaped and sized to releasably retain the bottom opening of the funnel against the funnel stowage location.

According to a further aspect of the invention, the funnel is plastic.

According to a further aspect of the invention, the wiping sheet positioned in the funnel is rolled into a tubular shape.

According to a further aspect of the invention, a removable cover is positioned on the top opening of the funnel.

BRIEF DESCRIPTION OF THE DRAWING FIGURES

The present invention is best understood when the following detailed description of the invention is read with reference to the accompanying drawings, in which.

and

Figure 14:
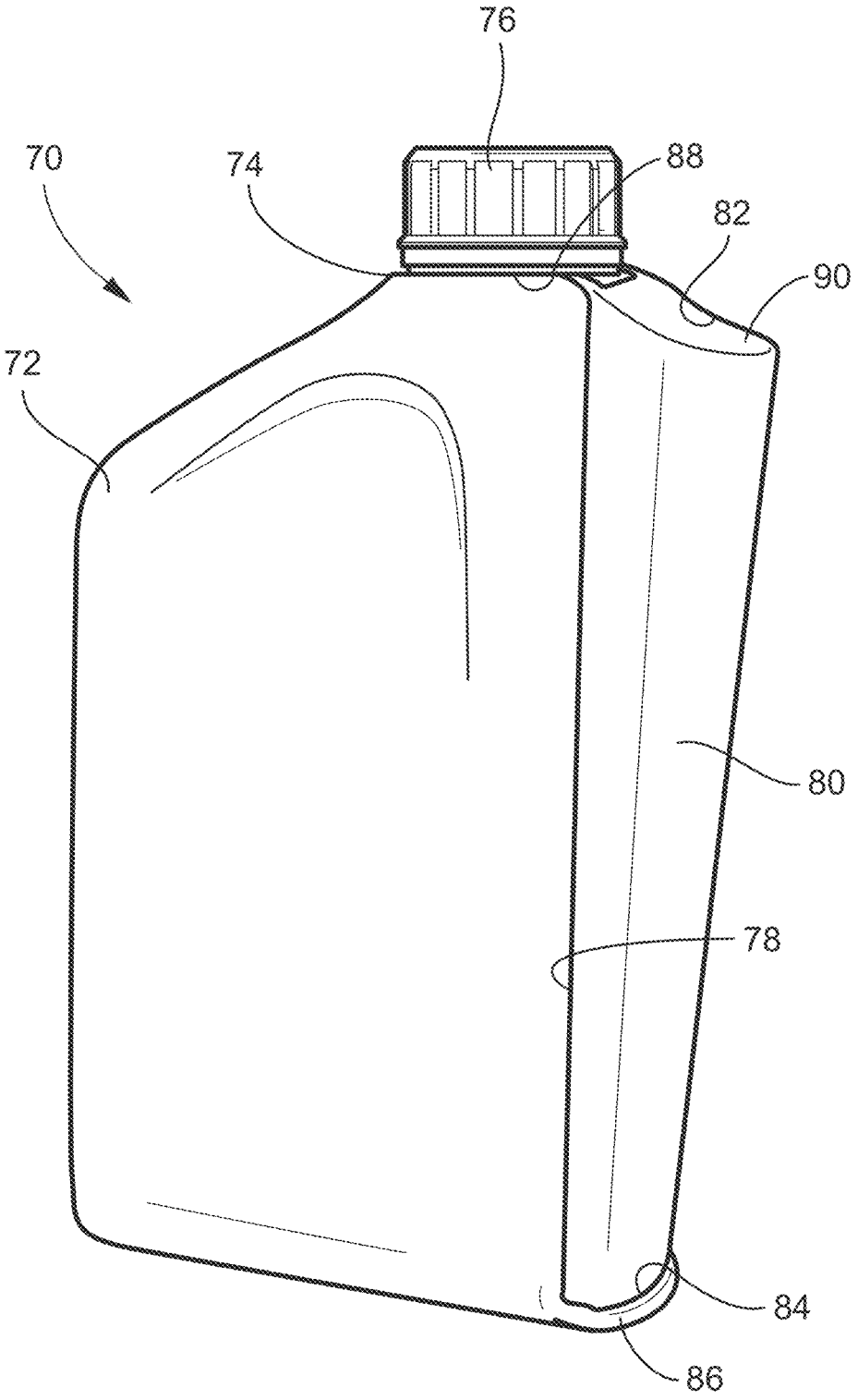
FIG. 14 is a perspective view of a container according to another preferred embodiment of the invention with a funnel in a stowage location connected to the front wall of the container.

FIGS. 15-20 are sequential perspective views of the container shown in FIG. 14 showing the funnel being deployed from the stowage location against the container into the use position.

DETAILED DESCRIPTION OF THE PREFERRED EMBODIMENT AND BEST MODE

Figure 1:
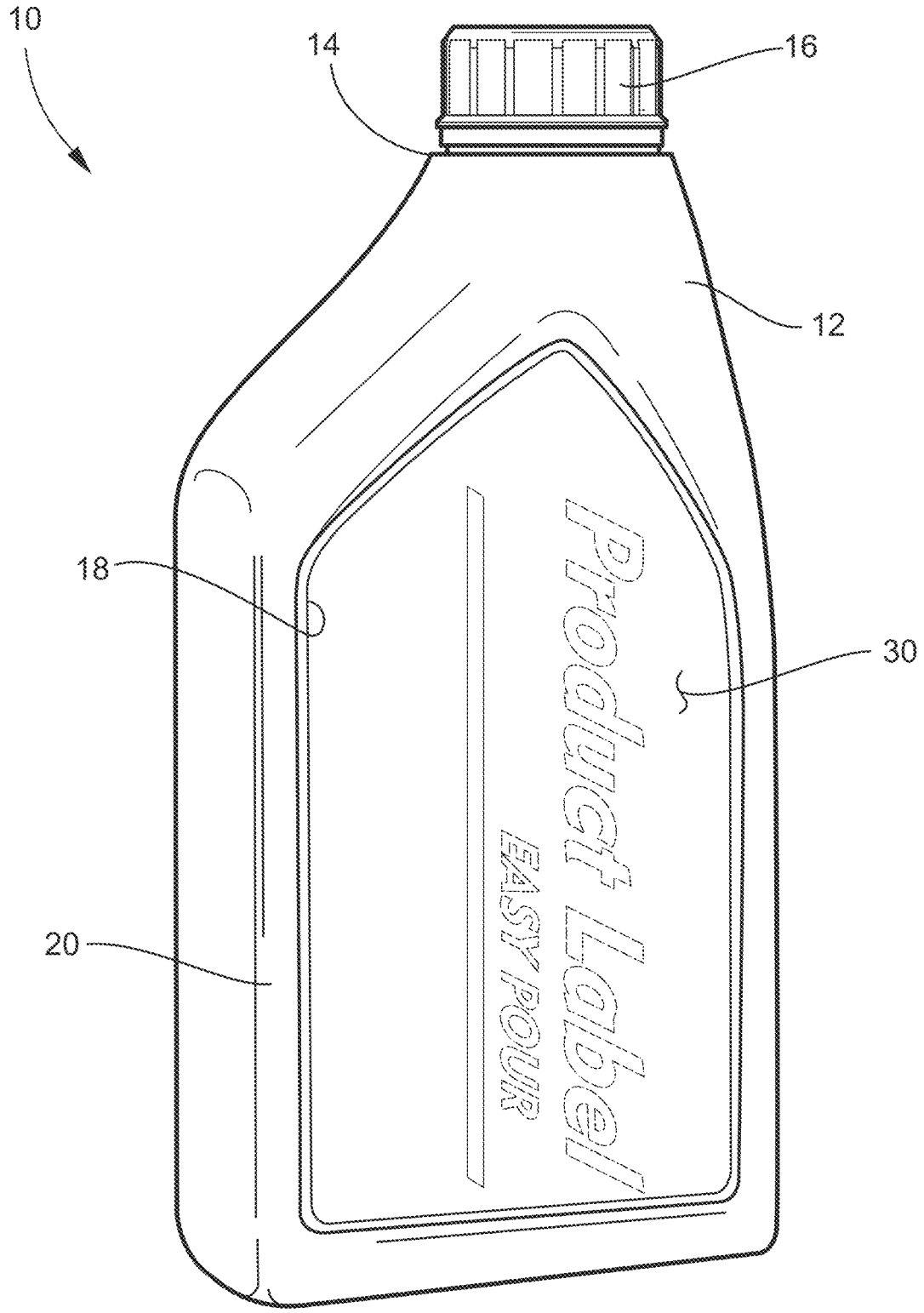
FIG. 1 is a perspective view of a container according to a preferred embodiment of the invention with a funnel in a stowage location within a recess in a sidewall of the container.
Figure 2:
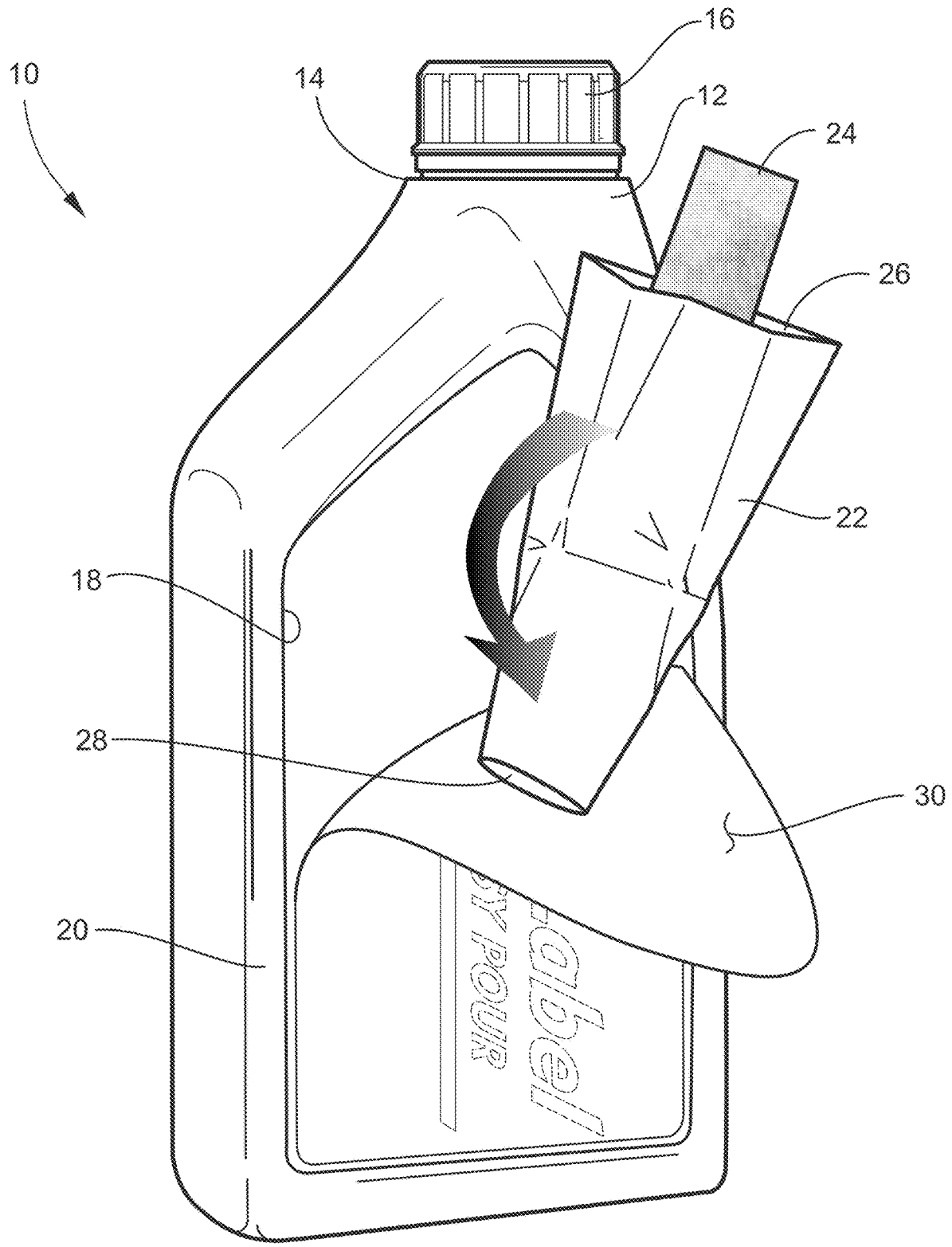
FIGS. 2-5 are sequential perspective views showing the funnel being deployed from the stowage location of FIG. 1 into the use position.
Figure 3:
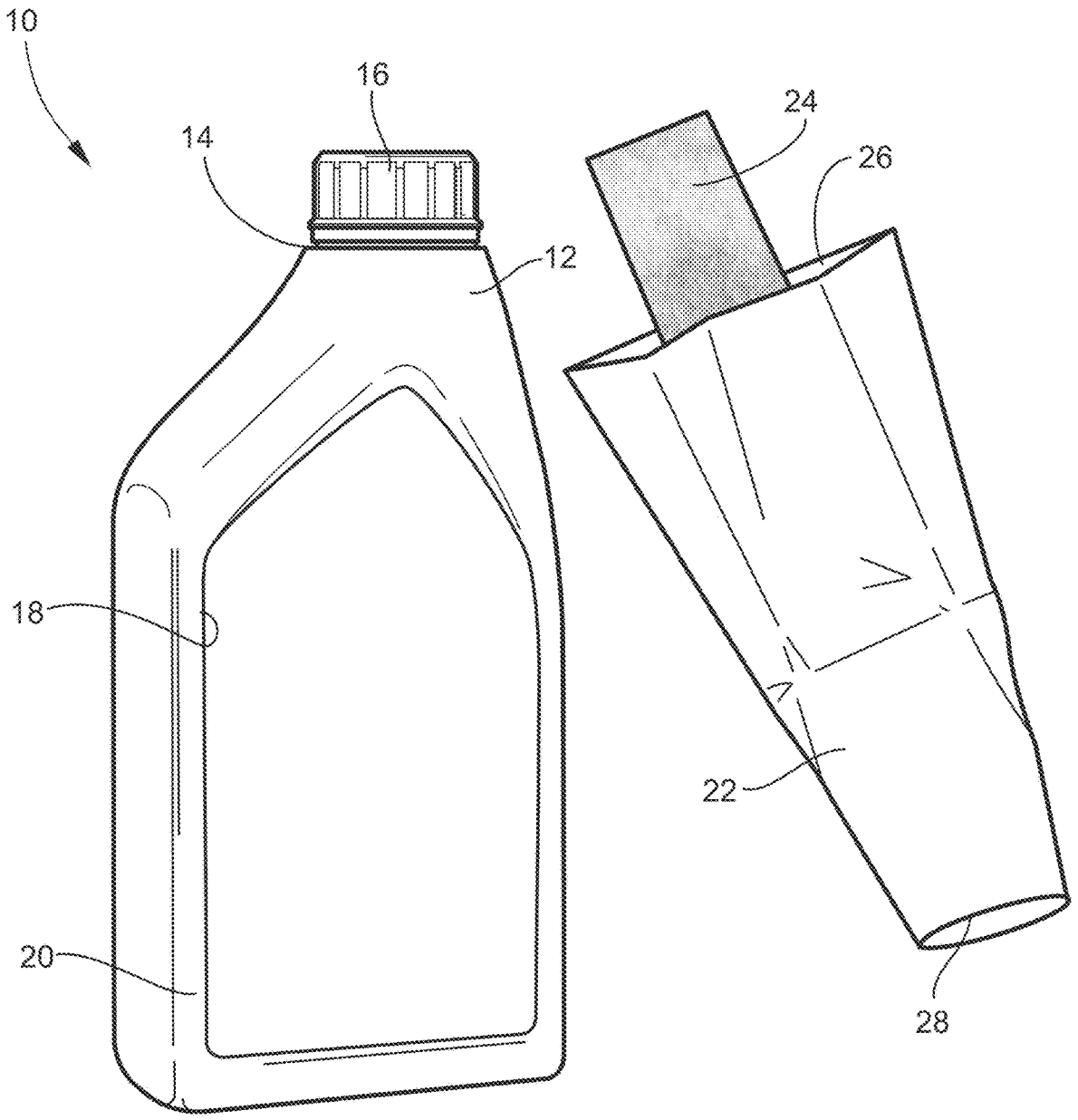
Figure 4:
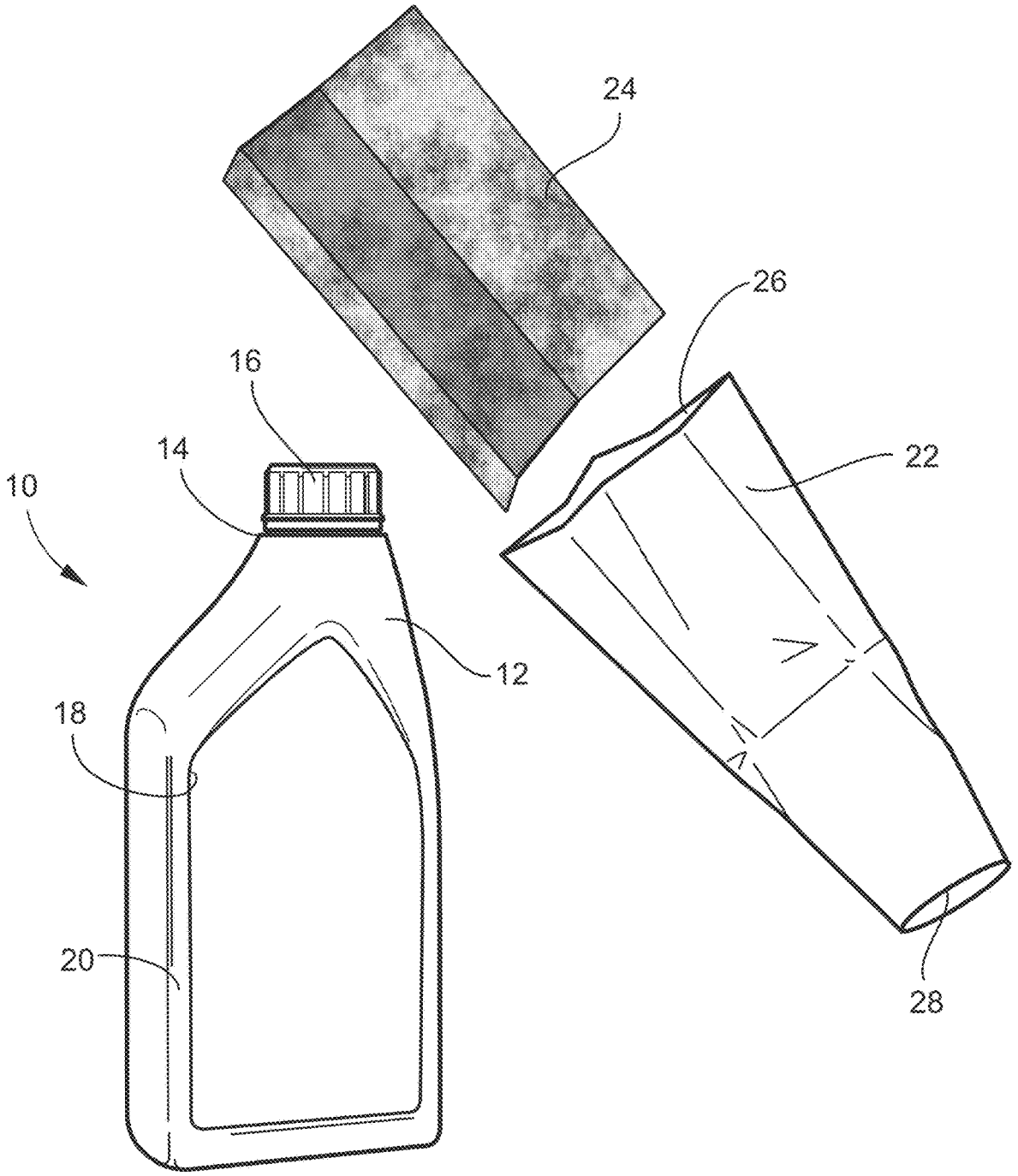
Figure 5:
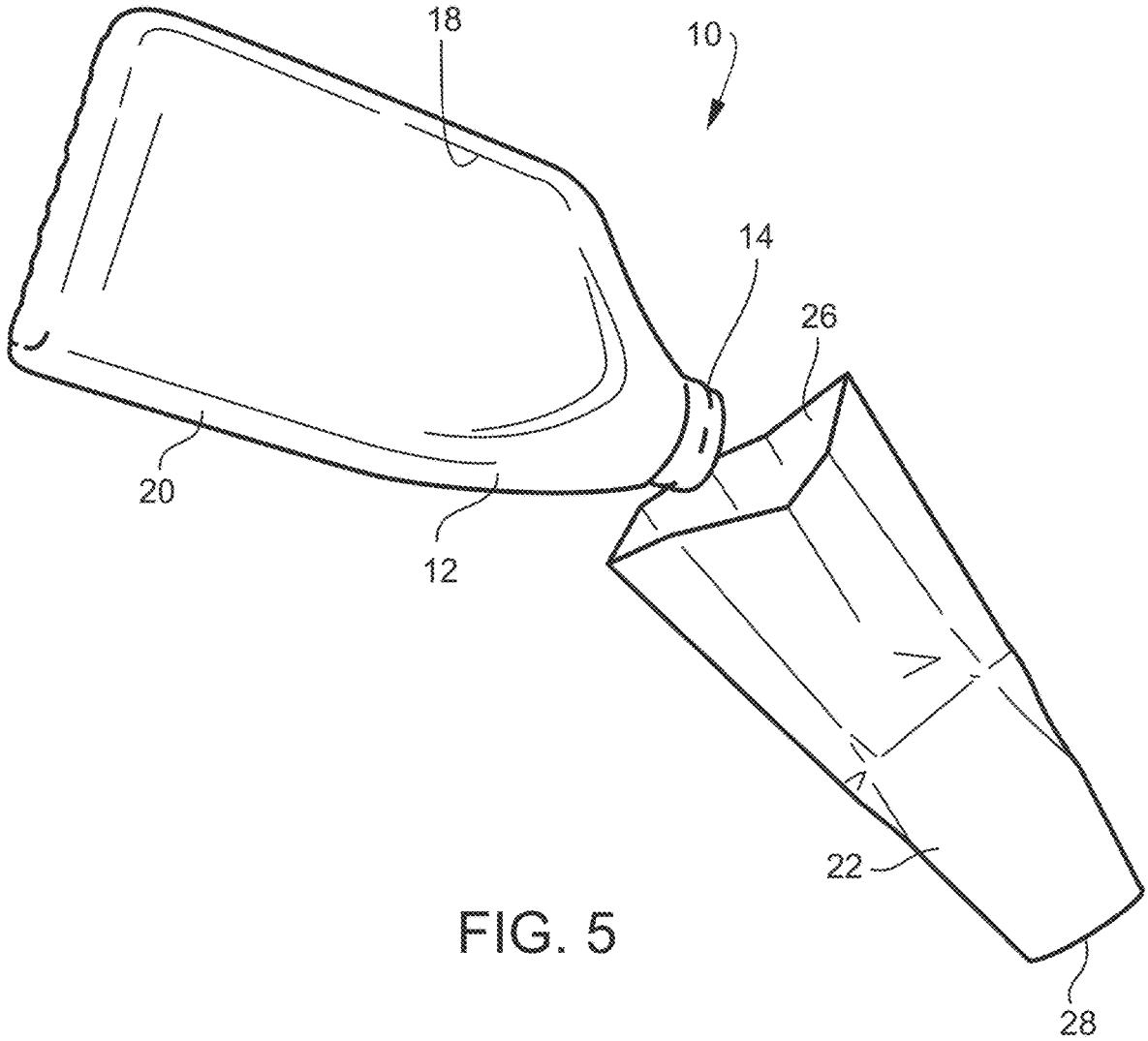
Figure 6:
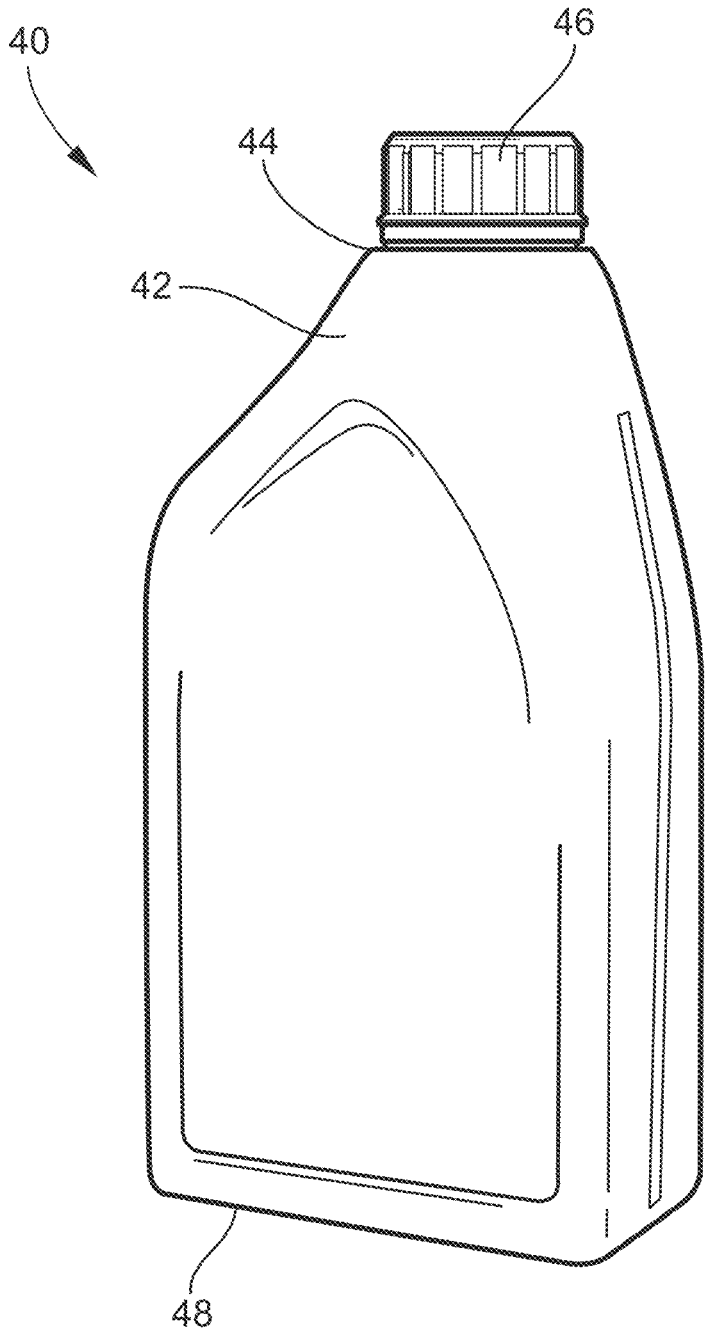
FIG. 6 is a perspective view of a container according to another preferred embodiment of the invention, with a funnel in a stowage location within a cavity in the bottom of the container.
Figure 7:
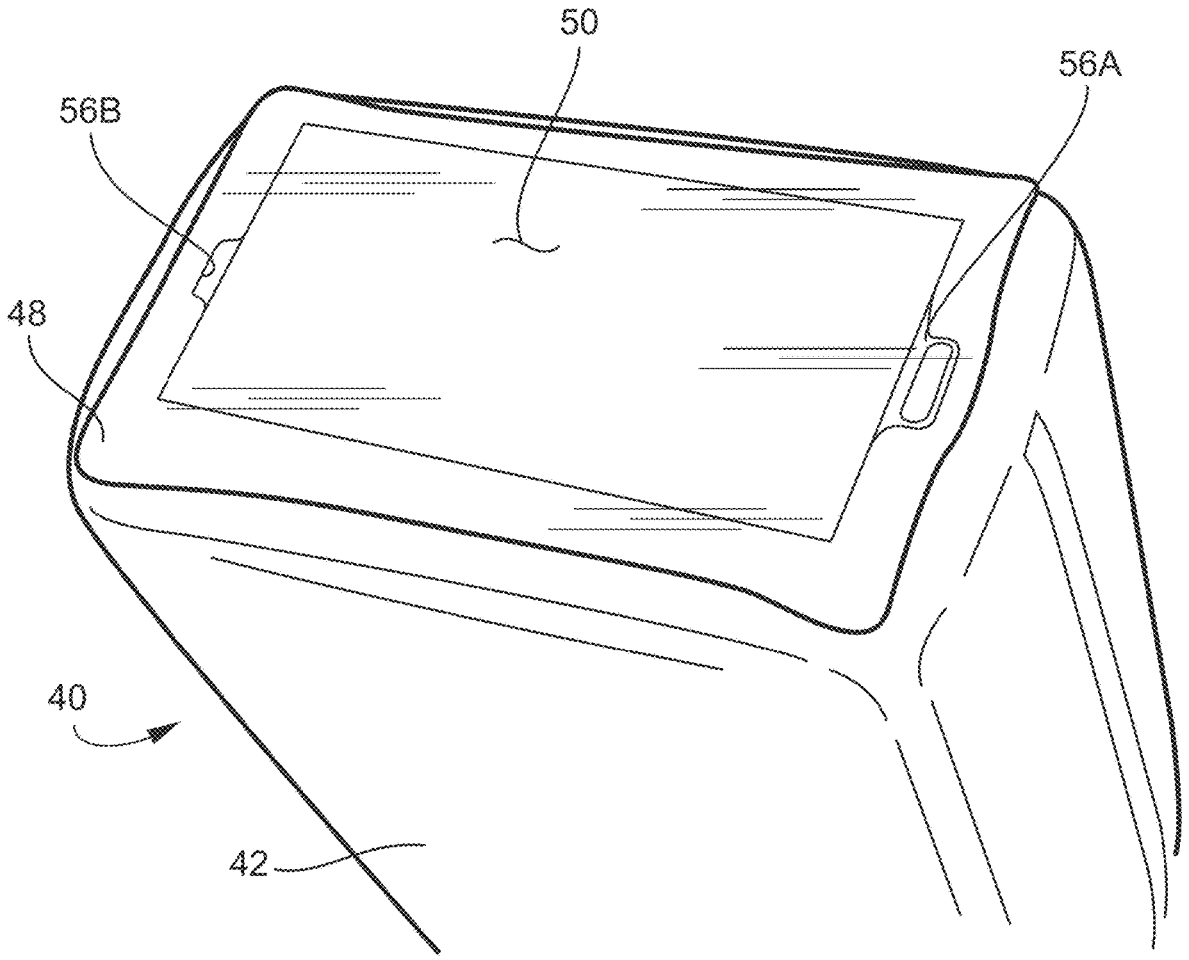
FIGS. 7-13 are sequential perspective views of the container shown in FIG. 6 showing the funnel being deployed from the stowage location in the cavity of the container into the use position.

In the following description the term "funnel" means a tube or pipe that has a large opening at the top and a small opening at the bottom, used for guiding a flowable material such as a liquid or powder into a small opening. Referring to FIGS. 1-5, a container 10 is shown, and includes a container body 12 with a raised, threaded dispensing opening 14 for receiving a threaded cap 16. The body 12 includes a shallow recess 18 forming a stowage location on at least one wall of the container 10. As shown in FIG. 1, the shallow recess 18 is formed on a side wall 20, see FIGS. 1 and 2, into which is positioned a flat-folded funnel 22 and a flat-folded wiping sheet 24, as shown in FIGS. 2, 3 and 4. The funnel 22 when unfolded as shown in FIG. 2 transitions from a relatively large top opening 26 to a relatively small bottom opening 28. While the funnel 22 preferably has a polygonal lateral cross-section with the top opening 26 and the bottom opening 28 defining polygonal shape, other funnel shapes, for example, a conical shape with circular-shaped top and bottom openings are also possible. As shown, the recess 18 occupies substantially all of the flat surface of the side wall 20, and preferably at least 50 percent of the area of the side wall 20. With large containers the recess may occupy less than 50 percent of the area of the side wall 20.

The funnel 22 may be constructed from any sheet material that can be formed into a funnel, folded for stowage and then expanded back into the funnel for use, for example, paper, plastic or resin. The funnel 22 may be maintained in its funnel shape by any suitable chemical or mechanical adherent, such as glue, adhesive tape, or a folded pleat that is stapled or otherwise secured.

The wiping sheet 24 may be any sheet suitable for folding and sufficiently absorbent to retain within its volume flowable materials such as liquids or powders which may be wiped from a surface by the wiping sheet 24. Conventional paper toweling or commercial hand wiping towels are suitable. When the product being dispensed is a dry product such as a powder, the wiping sheet may be moistened and contained within a moisture resistant package.

As best shown in FIGS. 3 and 4, the wiping sheet 24 is preferably positioned in its flat-folded condition within the funnel 22, which is itself flat-folded. When the funnel 22 is unfolded the wiping sheet 24 can be easily be removed from the opened funnel 22 and unfolded. The dimensions of the funnel 22 and the wiping sheet 24 are widely variable and the size of the top opening 26 and the bottom opening 28 will be determined based on the size of the container dispensing opening 14, the anticipated size of the opening into which the container contents are to be dispensed and similar factors. See FIG. 5.

The flat-folded funnel 22 and the flat-folded wiping sheet 24 is preferably stowed against the side wall 20 in the recess 18 behind a cover, such as a product identification label 30. Preferably the flat-folded funnel 22 and the flat-folded wiping sheet 24 are sized and shaped to reside in the recess 18, leaving an exposed peripheral edge of the recess 18 to which the label 30 may be adhered until the label 30 is removed to expose the flat-folded funnel 22 and the flat-folded wiping sheet 24 for use. The wiping sheet 24 is sized to be suitable for hand wiping and wiping container contents off of surfaces onto which the contents may have spilled.

Figure 8:
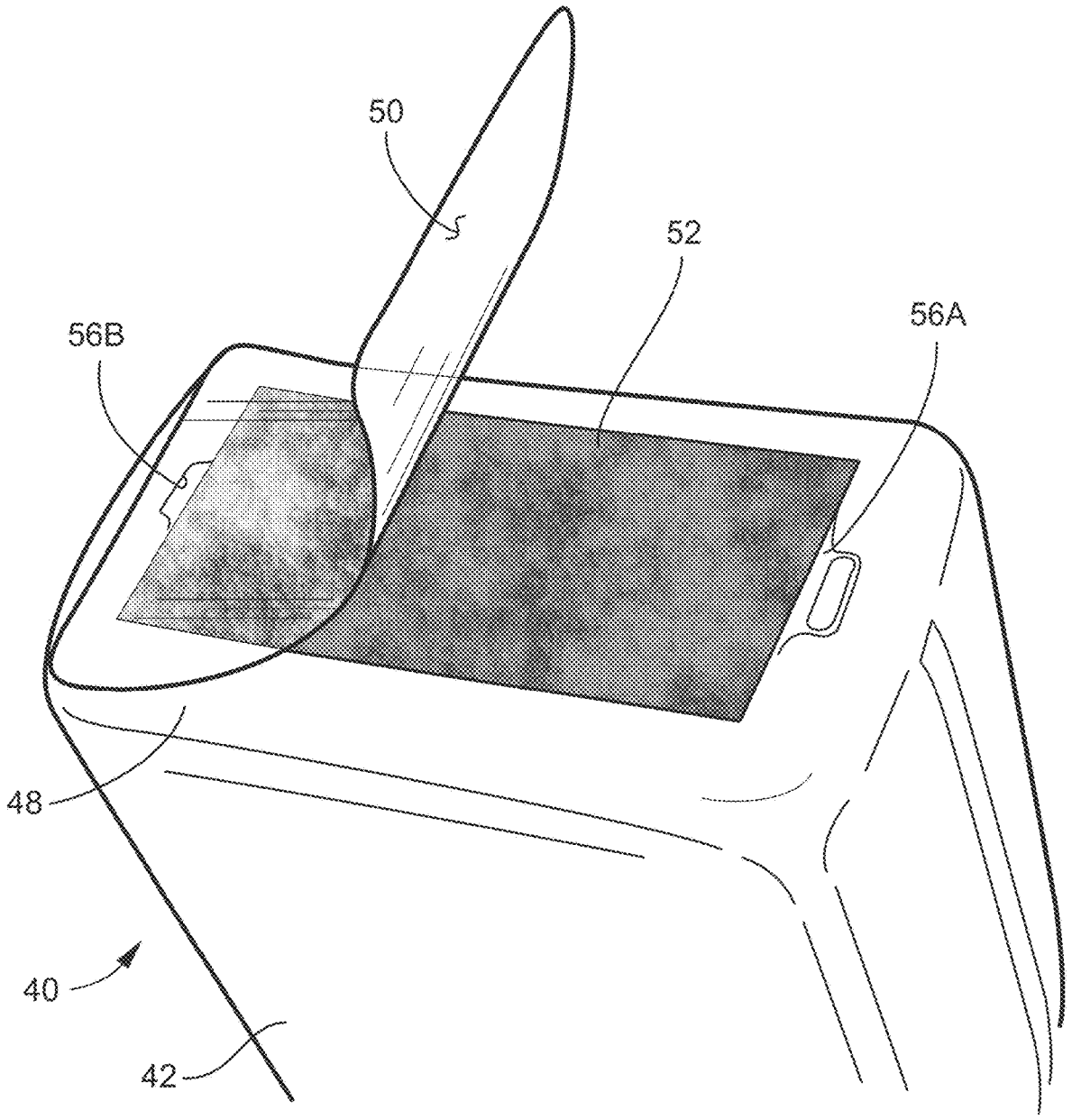
Figure 9:
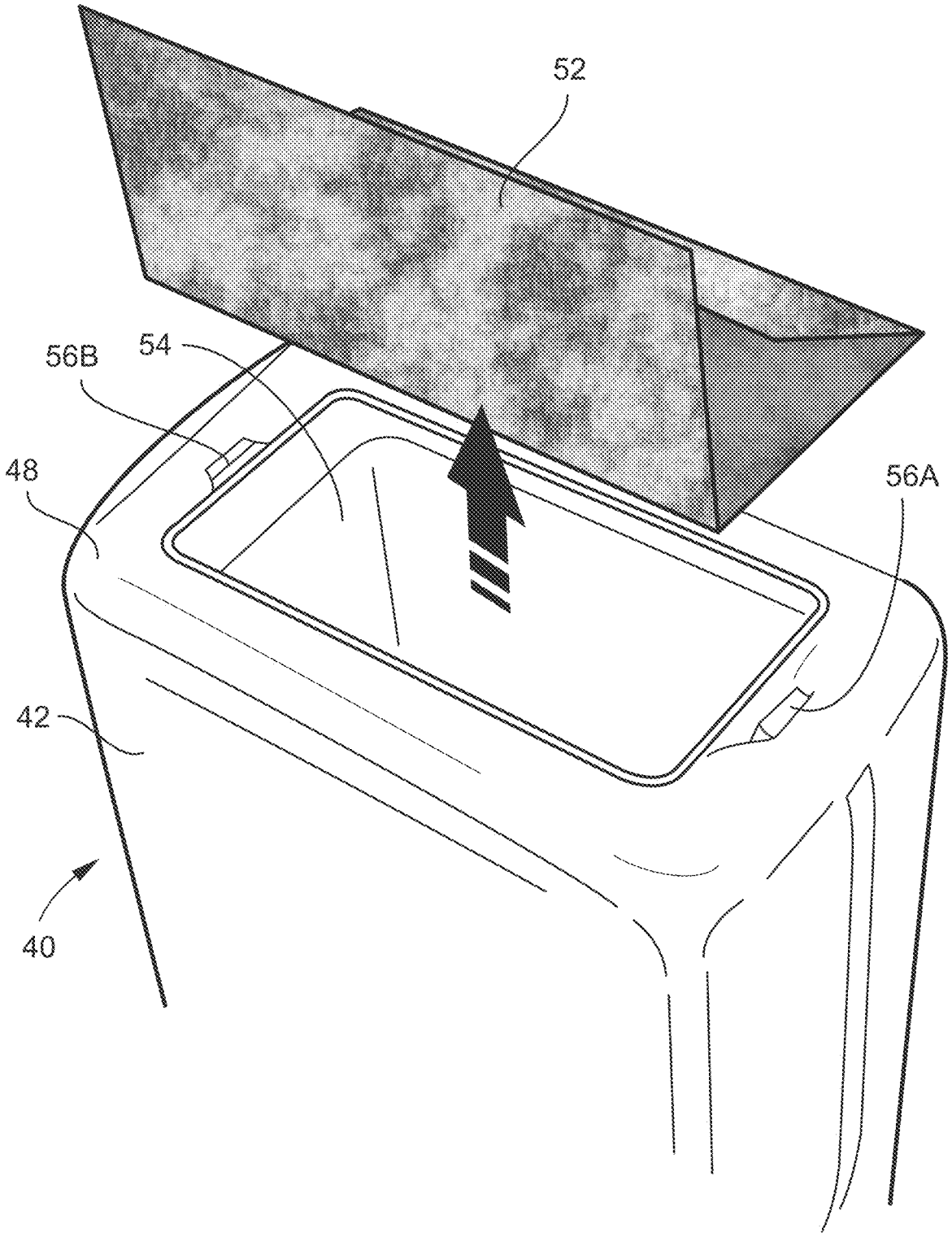
Figure 10:
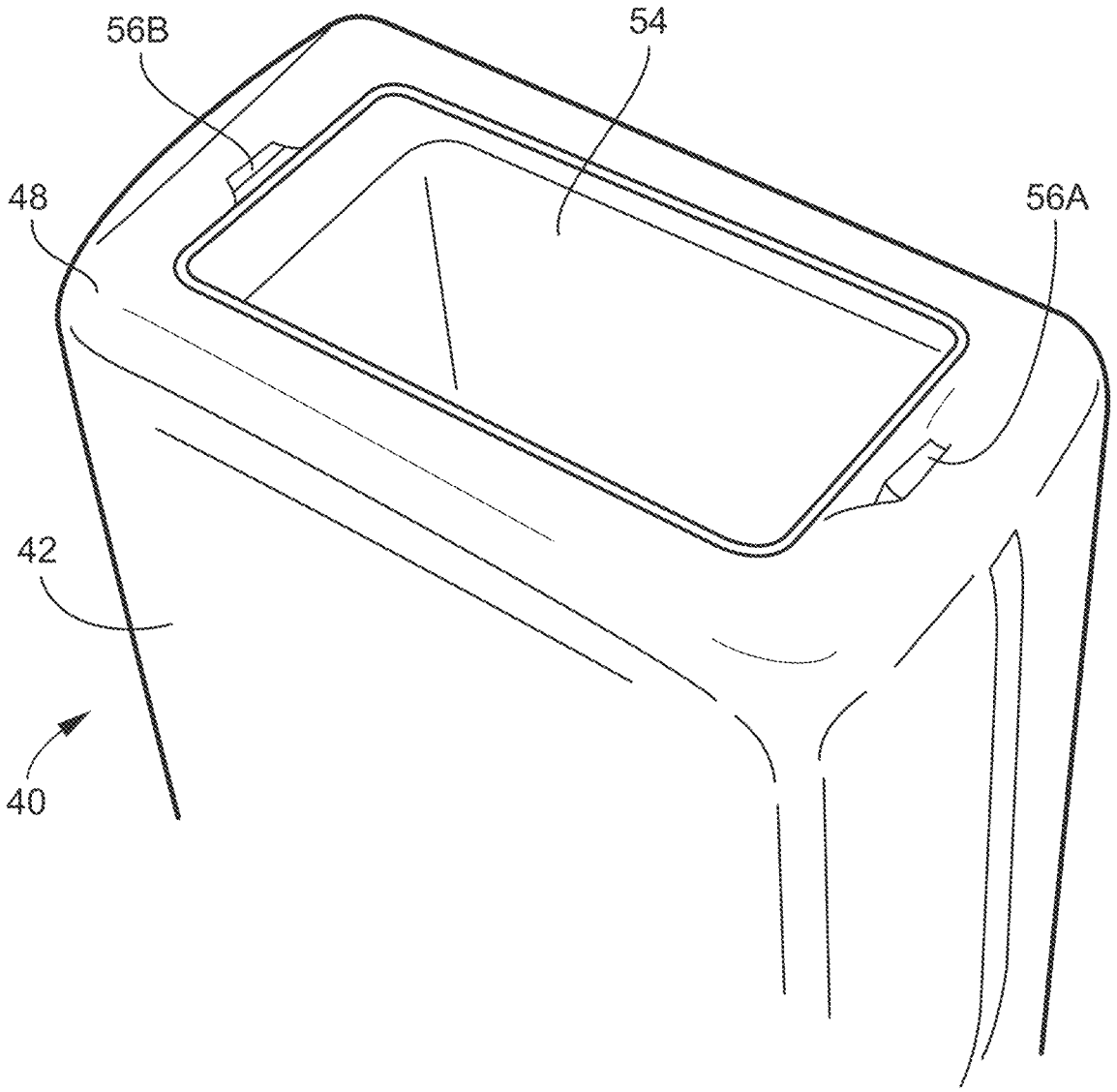

Referring now to FIGS. 6-13, a container 40 is shown, and includes a container body 42 with a threaded dispensing opening 44 for receiving a threaded cap 46. As shown sequentially beginning with FIG. 7, a bottom 48 of the container 40 is overlaid with a removable, adhesively-adhered cover 50. When the cover 50 is removed as shown in FIG. 8, a flat-folded wiping sheet 52 is exposed. As shown in FIGS. 9 and 10, when the wiping sheet 52 is removed, a funnel 54 is exposed. Removing the funnel 54 reveals that the bottom 48 of the container body 42 includes a stowage location in the form of an integrally-formed cavity 56 into which the funnel 54 is shaped and sized to be stowed until ready for use. The cavity includes finger access dimples 56A, 56B to aid in removing the cover 50.

Figure 11:
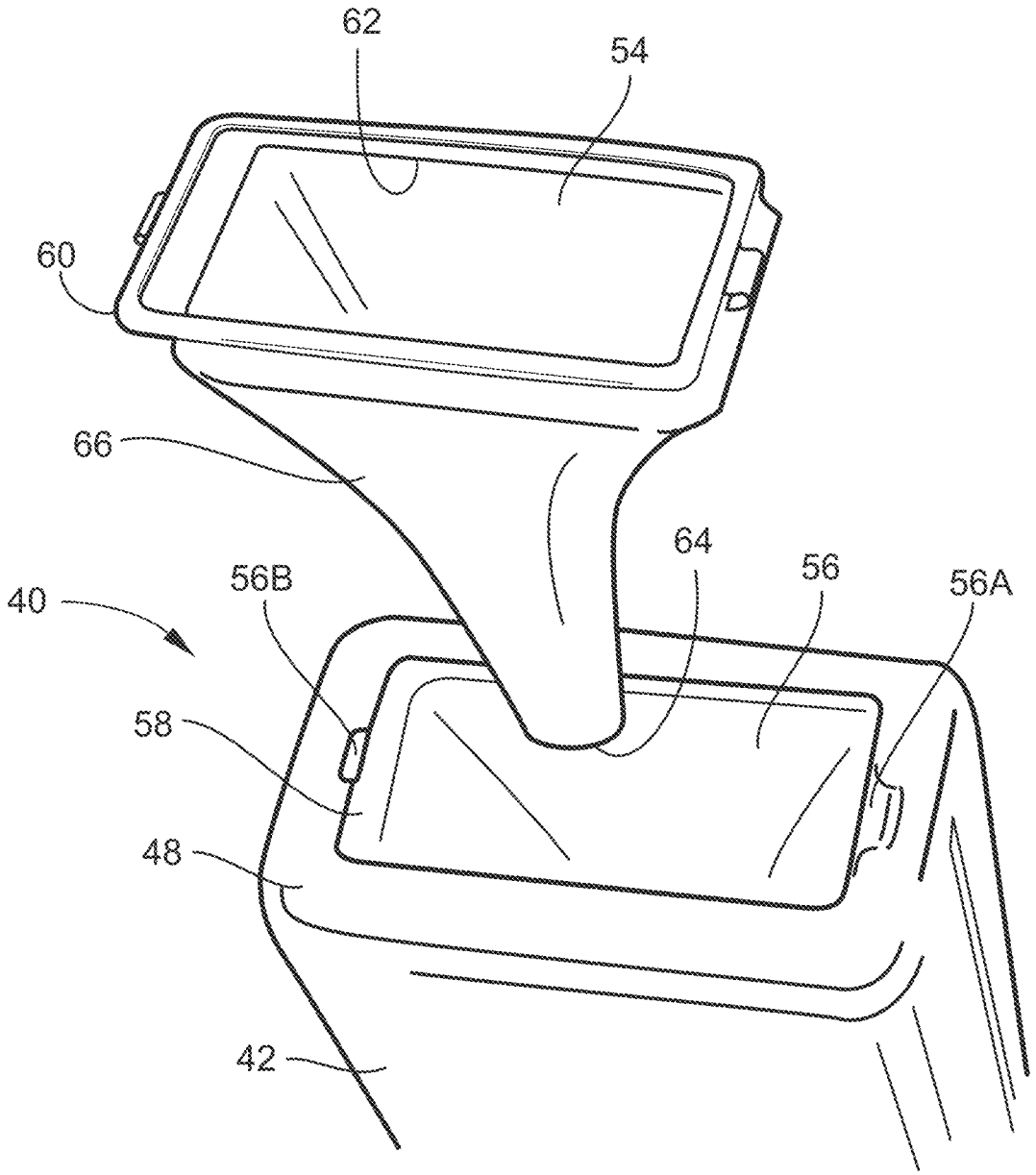

As shown in FIG. 11, the container body 42 includes a peripheral shoulder 58 on which a rim 60 of the funnel 54 resides when stowed in the cavity 56. The funnel 54 includes a relatively large top opening 62 for receiving the contents of the container 40 that transitions to a relatively small bottom opening 64 through which the contents of the container 40 are dispensed from the funnel 54. The side wall 66 of the funnel 54 may be concave curved, as shown in FIGS. 11 and 12.

Figure 12:
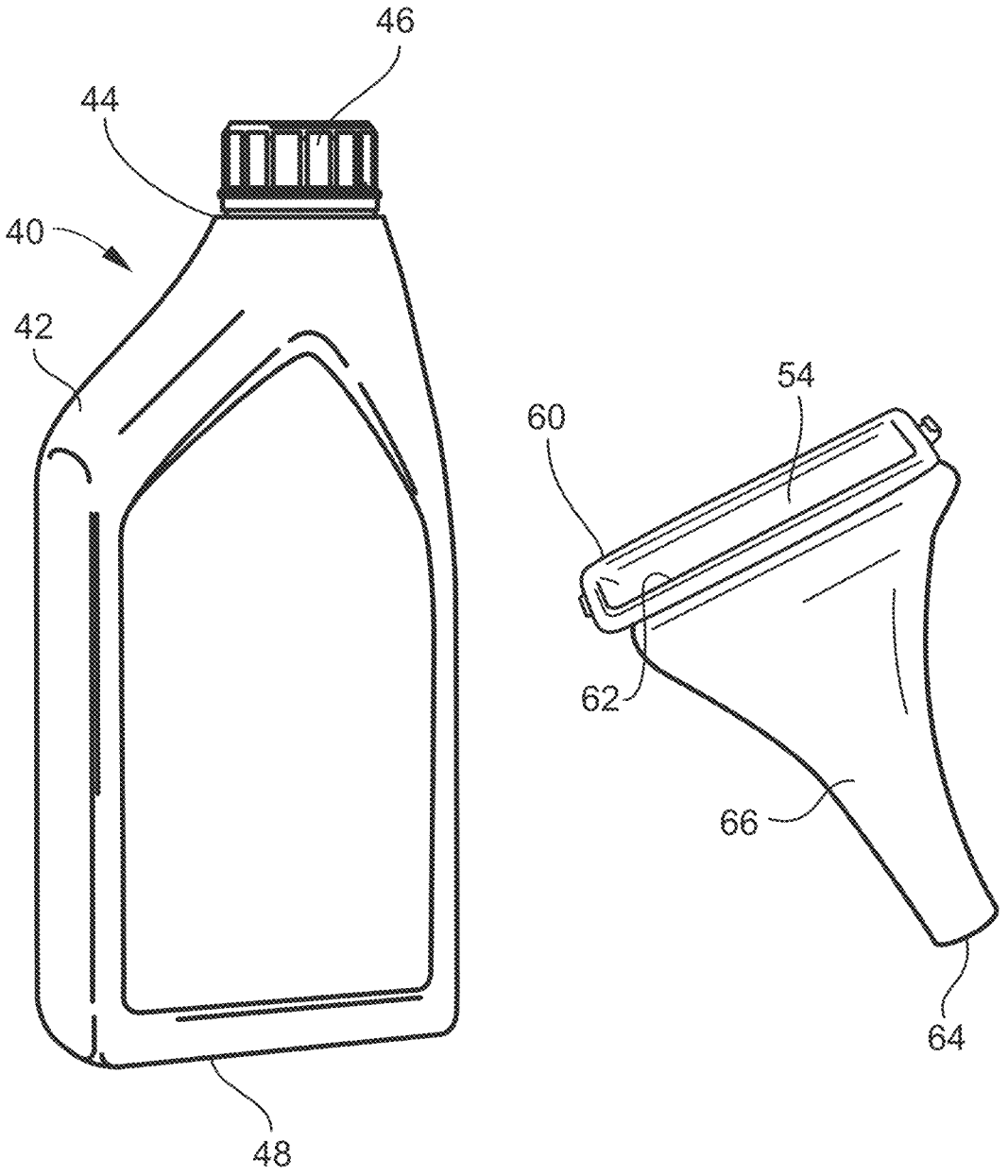
Figure 13:
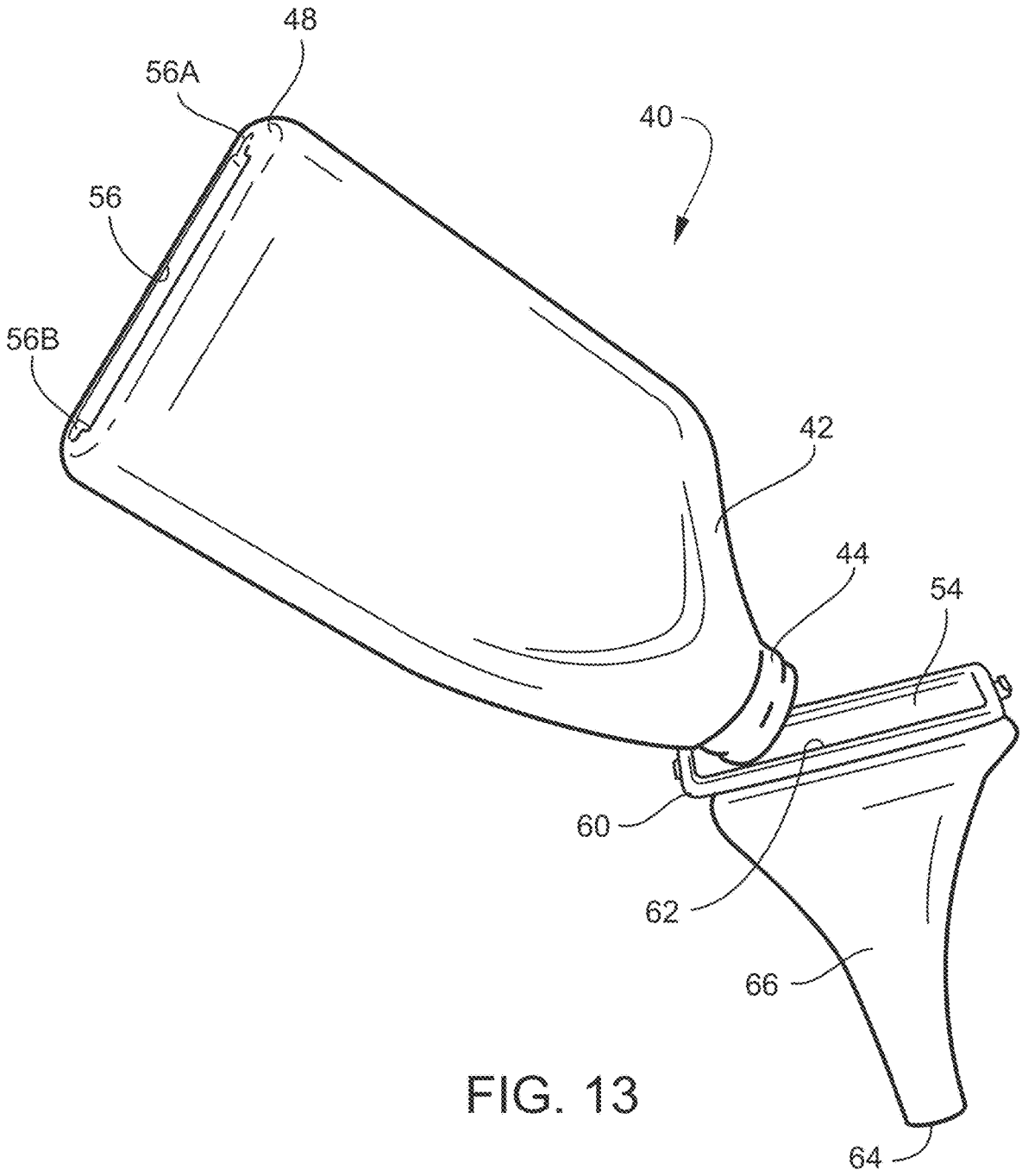

When removed from the cavity 56, the funnel 54 is then positioned in relation to the dispensing opening 44 of the container 40 whereby the container contents may be poured into the funnel 54, as shown in FIG. 12. As shown in FIG. 13 the funnel 54 may be disposed of if the container 40 is empty, or returned to its position in the cavity 56 for later use of the container 40 if not empty.

The funnel 54 may be constructed from any plastic or resin material that can be formed into a funnel shape, for example, by blow molding, injection molding or other conventional molding process. The funnel 54 is shown having a generally quadrilateral configuration conforming to the shape of the container 40 and the cavity 56. In other container configurations, for example oval or circular, the cavity can assume a similar shape and thus the funnel will preferably be similarly shaped.

The wiping sheet 24 may be any sheet suitable for folding and sufficiently absorbent to retain within its volume liquids or other flowable materials which may be wiped from a surface by the wiping sheet 24. Conventional paper toweling or commercial hand wiping towels are suitable.

Figure 15:
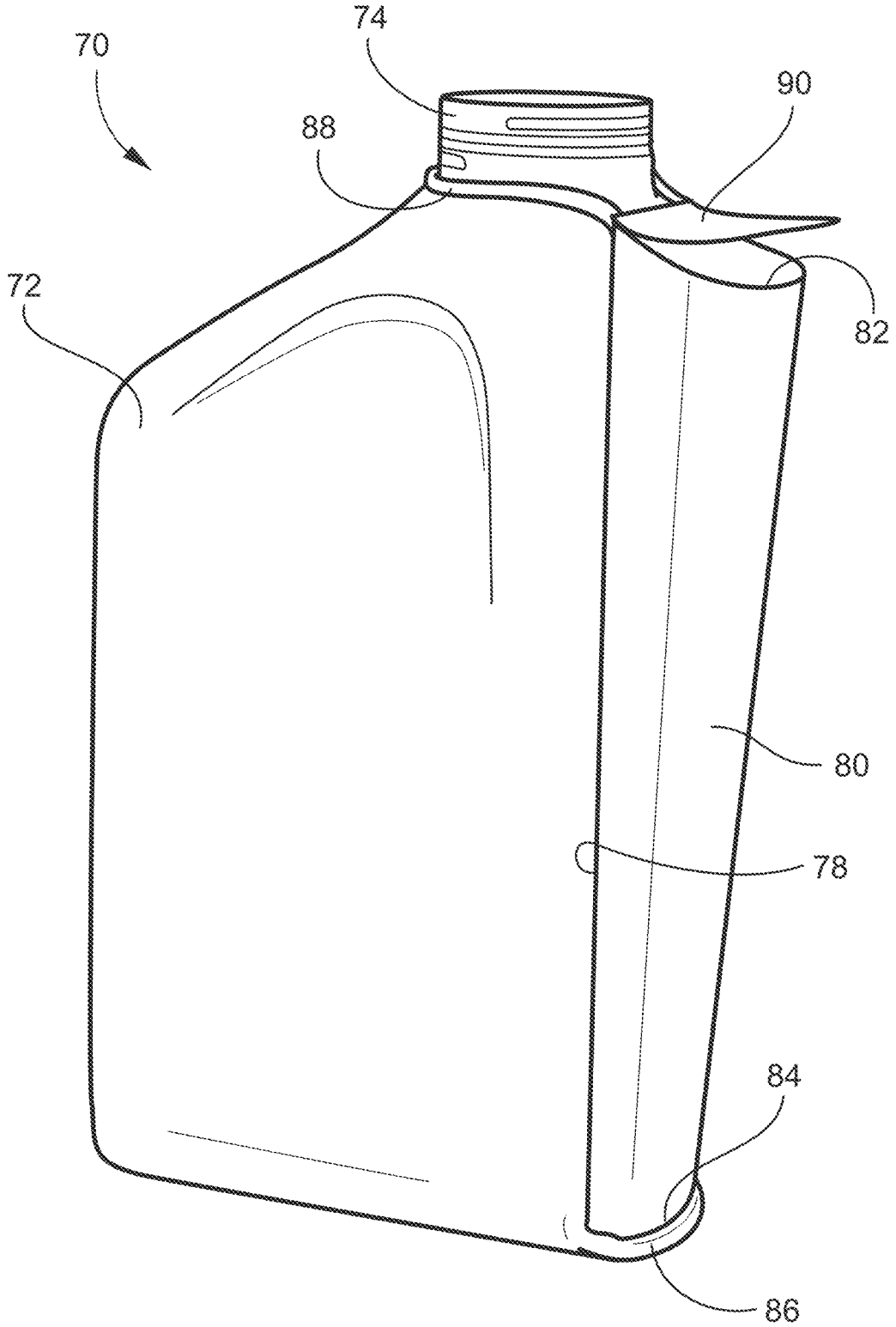

Referring now to FIGS. 14-20, a container 70 is shown, and includes a container body 72 with a threaded dispensing opening 74 for receiving a threaded cap 76. As best shown in FIGS. 14 and 15, the container body 72 includes a stowage location defined by a front wall 78 against which is stowed a funnel 80 having a relatively large top opening 82 and a relatively small bottom opening 84.

The funnel 80 is held in its stowed position by a seat 86 formed in the container body 72 proximate the bottom of the front wall 78 into which a bottom end of the funnel 80 proximate the bottom opening 84 is positioned. A loop 88 carried proximate the top opening 82 of the funnel 80 is extended over the dispensing opening 74 and then the threaded cap 76 is screwed into place, capturing the funnel 80 in its stowed position.

Figure 16:
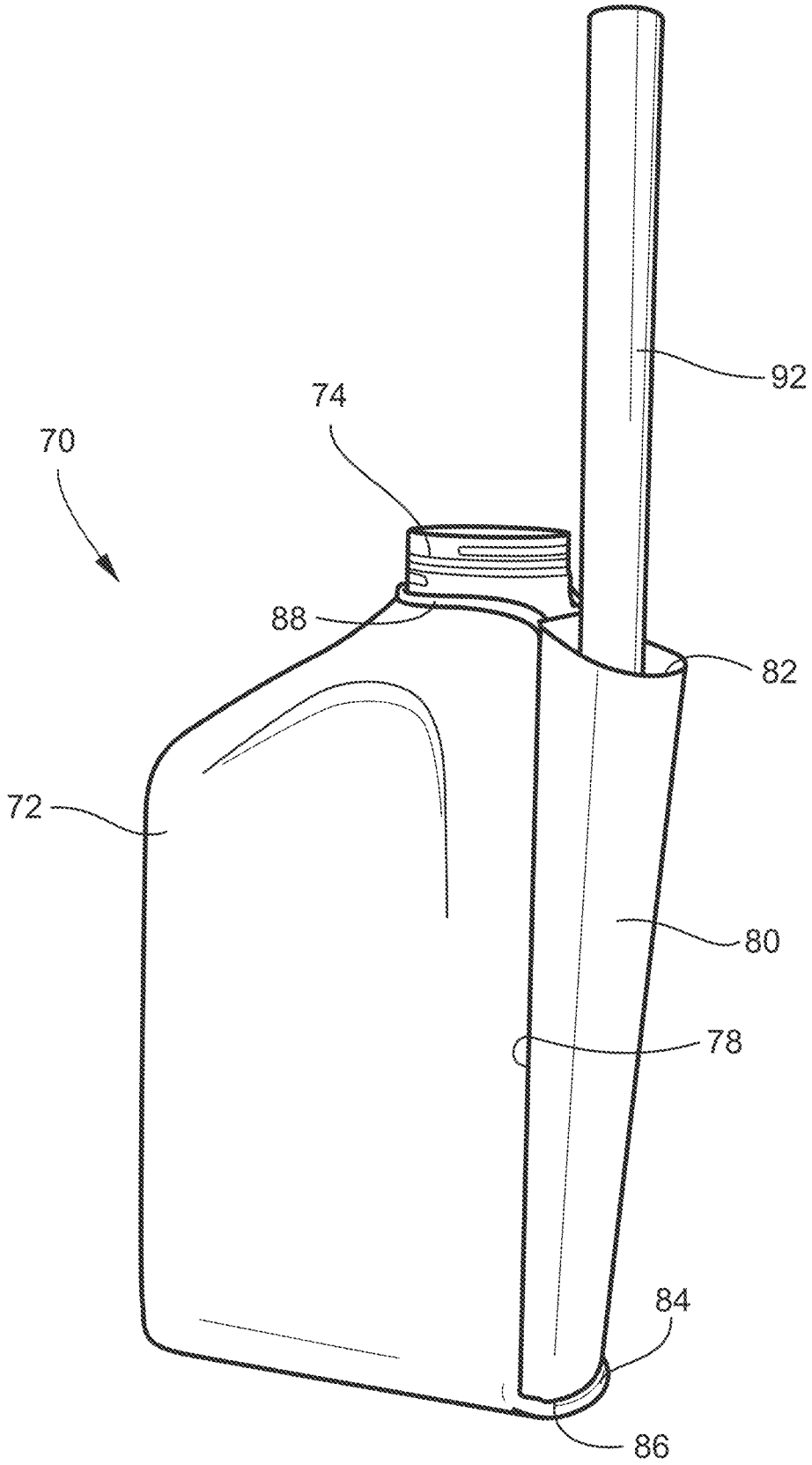
Figure 17:
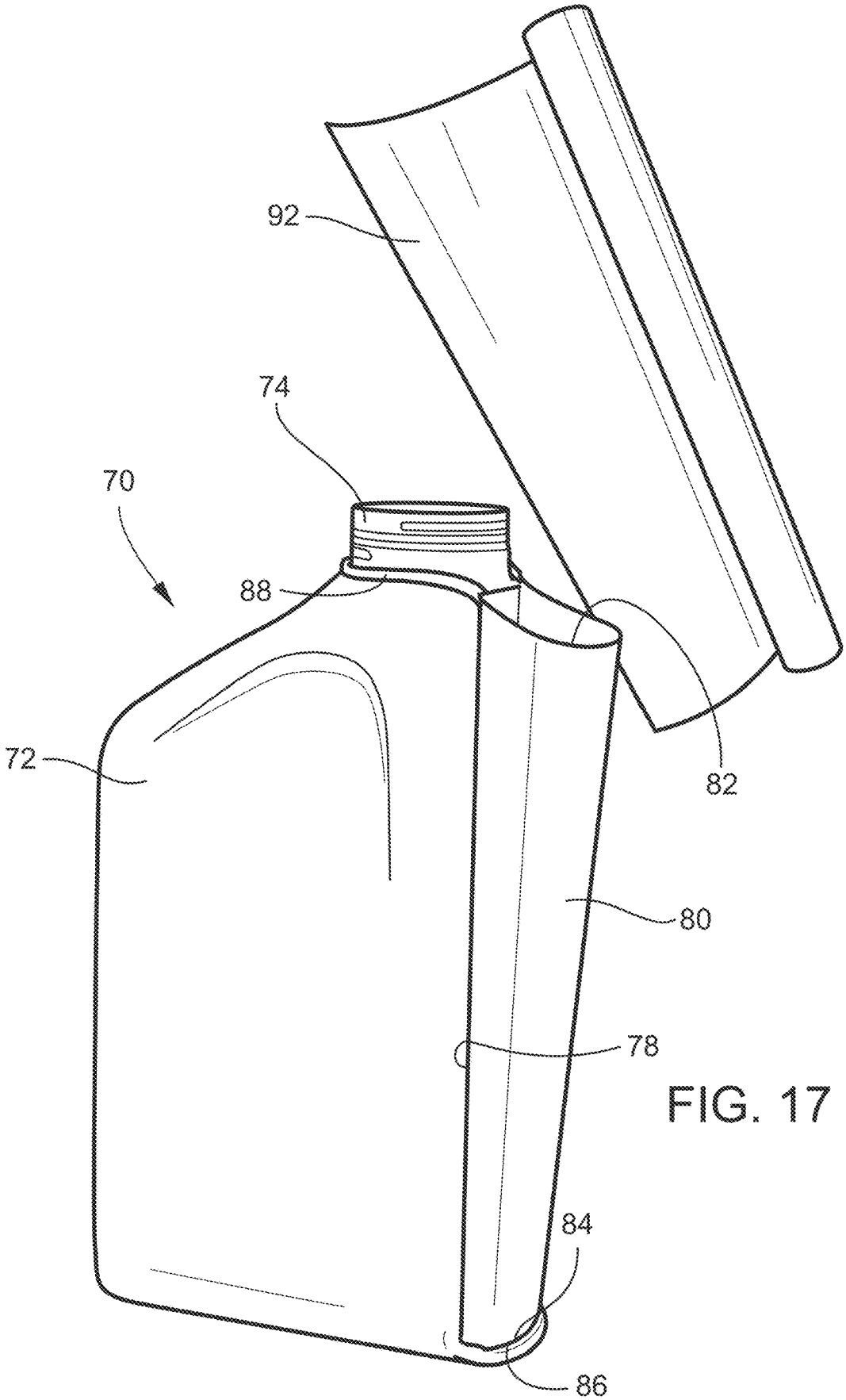

As also shown in FIGS. 14 and 15, the funnel 80 preferably includes a removable cover 90 positioned over the top opening 82 of the funnel 80 and enclosing the interior of the funnel 80. A wiping sheet 92 is positioned in the funnel 80 and is removable for use. As best shown in FIGS. 16 and 17, the wiping sheet 92 is preferably rolled into a tube that is sized to fit into the interior of the funnel 80, but can be folded into any suitable configuration, for example in pleats, that will enable the wiping sheet 92 to fit into the interior of the funnel 80.

Figure 18:
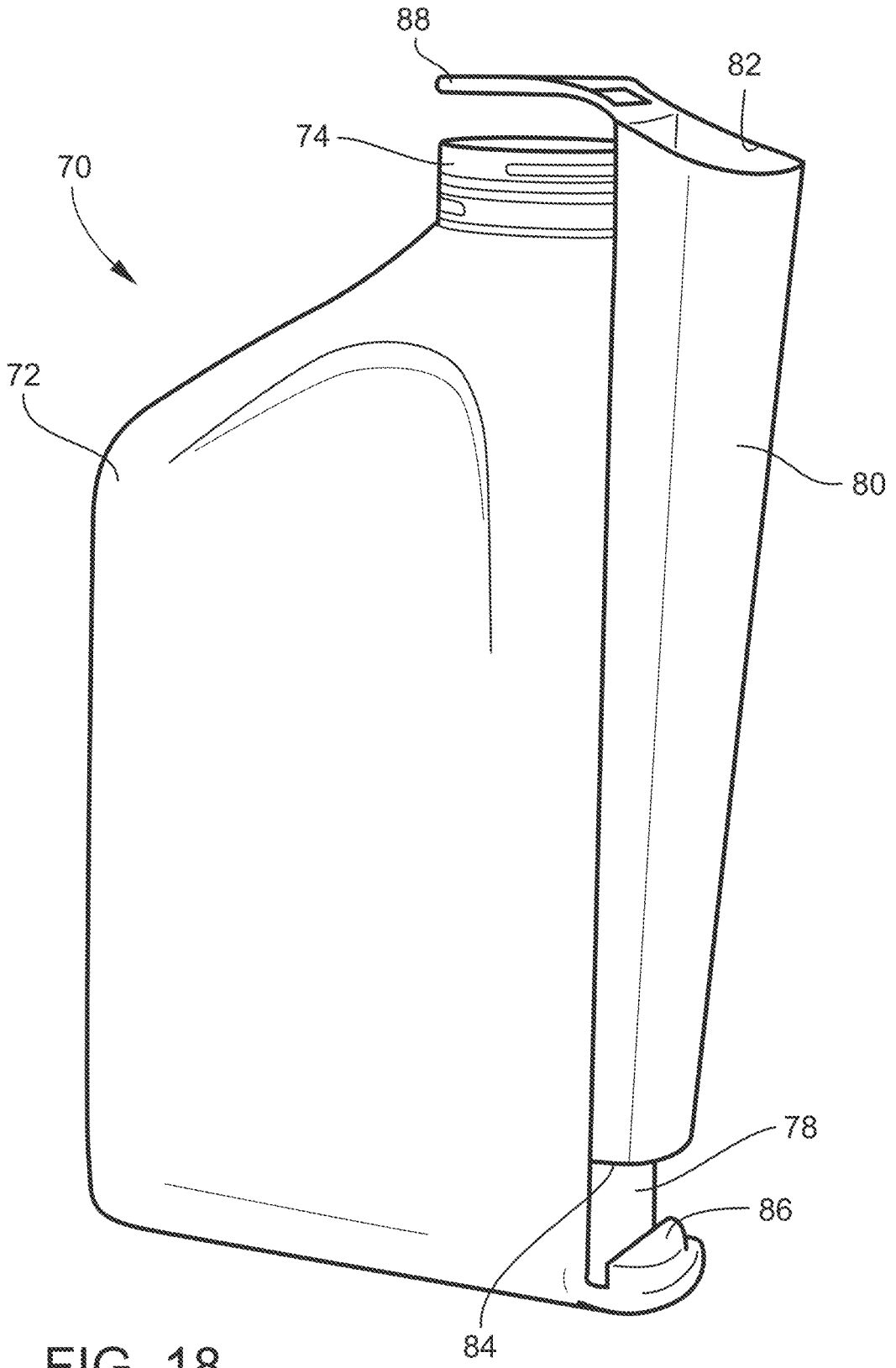
Figure 19:
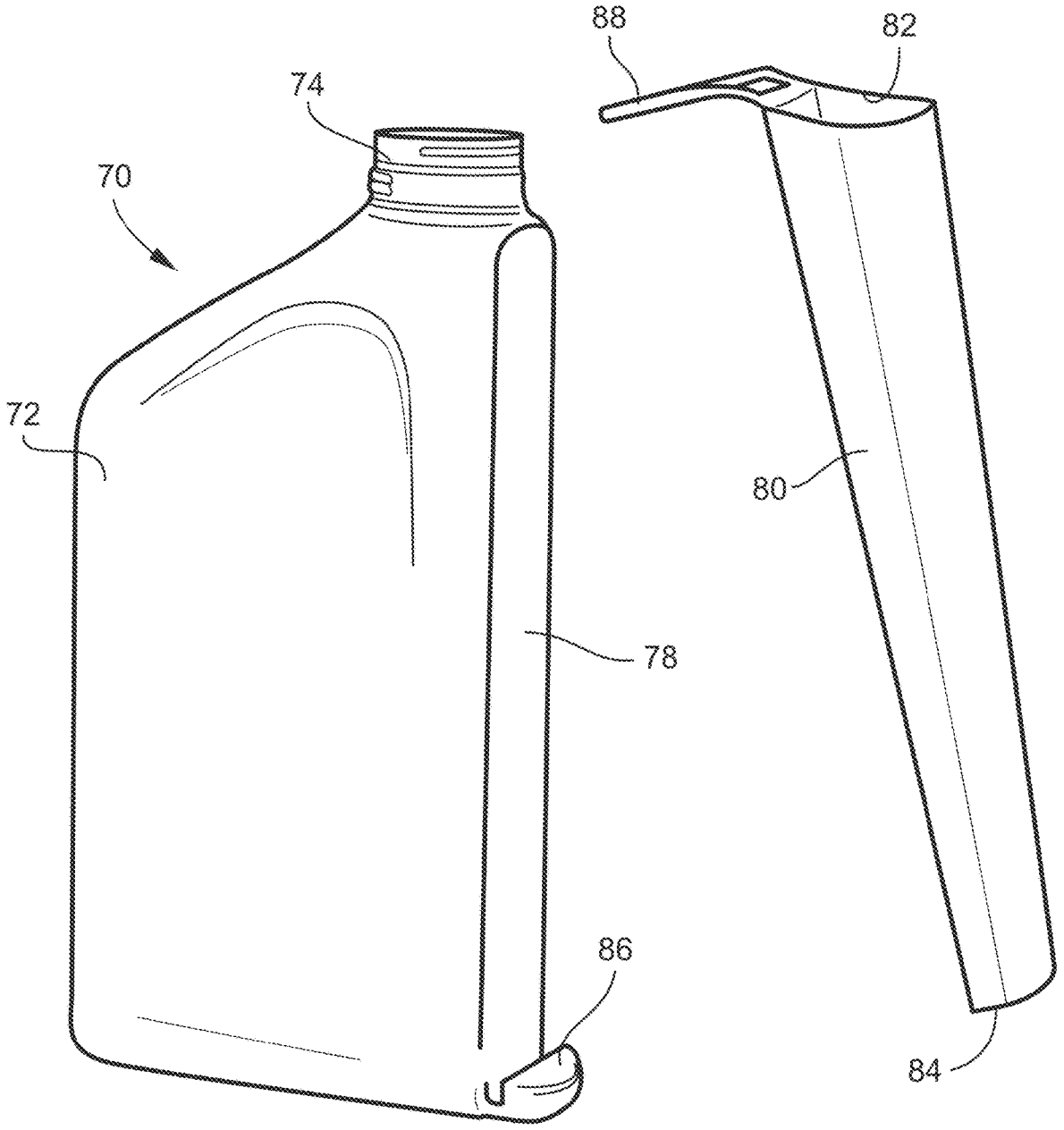
Figure 20:
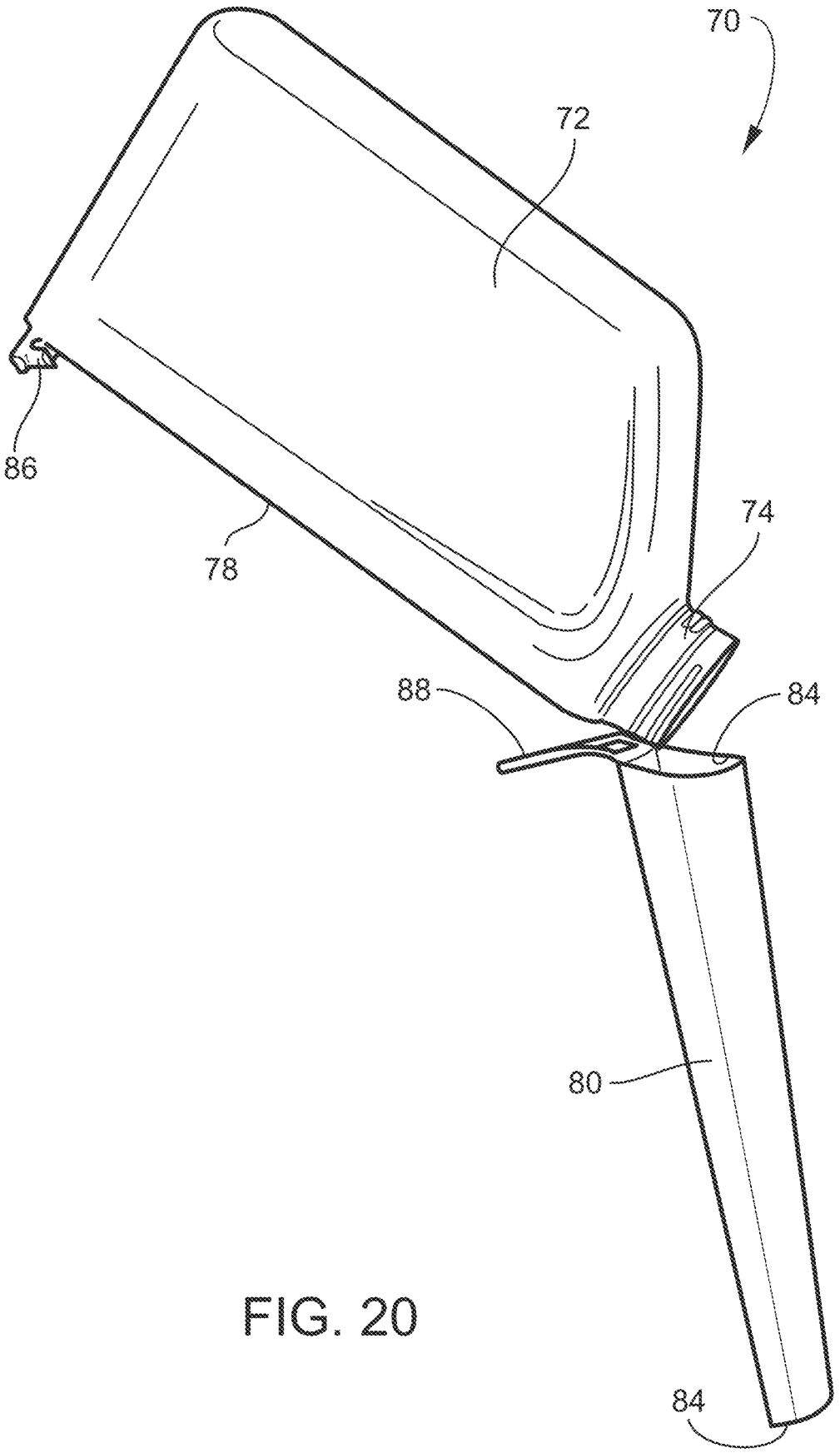

Referring to FIG. 18, the funnel 80 is removed from the container 70 by removing the threaded cap 76 from the dispensing opening 74 of the container 70 and lifting the loop 88 upwardly and off of the threaded dispensing opening 74. At the same time, the bottom opening 84 of the funnel 80 is lifted away from the seat 86. By removing the funnel 80 from the container 70, as shown in FIG. 19, the top opening 82 of the funnel 80 can then be oriented with the threaded dispensing opening 74 of the container 70 and the container 70 contents dispensed through the length of the funnel 80.

The funnel 80 may be constructed from any plastic or resin material that can be formed into a funnel shape, for example, by blow molding, injection molding or other conventional molding process. The funnel 80 is shown having a generally semicircular configuration. Other configurations are possible. The funnel 80 may be disposed of if the container 70 is empty, or returned to its stowage location on the front wall 78 of the container 70 for later use of the container 70 if not empty.

The wiping sheet 92 may be any sheet suitable for folding or rolling, and sufficiently absorbent to retain within its volume liquids or other flowable materials which may be wiped from a surface by the wiping sheet 92. Conventional paper toweling or commercial hand wiping towels are suitable.

A container has been described with reference to specific embodiments and examples. Various details of the invention may be changed without departing from the scope of the invention. Furthermore, the foregoing description of the preferred embodiments of the invention and best mode for practicing the invention are provided for the purpose of illustration only and not for the purpose of limitation, the invention being defined by the claims.

I claim:

1. A container, comprising:

a container body adapted for containing a flowable material for storage and dispensing through a dispensing opening in the container body;

a funnel positioned on a stowage location in the container body and adapted to be removed from the stowage location and moved to a flowable material receiving location physically separate from and proximate to the dispensing opening in the container body; and a wiping sheet positioned with the funnel in the stowage location and adapted to be removed from the stowage location and used to wipe and absorb the flowable material;

wherein the funnel includes an interior volume and the wiping sheet is positioned in the interior volume of the funnel when the funnel is positioned in the stowage location.

2. A container according to claim 1, wherein the wiping sheet in the stowage location with the funnel is in a folded configuration.

3. A container according to claim 1, wherein the stowage location is a recess formed in a side wall of the container.

4. A container according to claim 1, wherein the stowage location is a cavity formed in a bottom of the container.

5. A container according to claim 1, wherein the funnel comprises a sheet material having a relatively large top opening and a spaced-apart, relatively small bottom opening.

6. A container according to claim 4, wherein the funnel comprises a plastic material having a relatively large top opening and a spaced-apart, relatively small bottom opening and with an exterior configuration corresponding to the configuration of the cavity.

7. A container according to claim 5, wherein the funnel is polygonal in lateral cross-section.

8. A container according to claim 3, wherein the recess occupies at least 50 percent of an area of the side wall.

9. A container according to claim 8, and including a cover adhered to the bottom of the container and overlying the cavity.

10. A container, comprising:

(a) a container body adapted for containing a flowable material for storage and dispensing through a dispensing opening in the container body, including a wall extending between the dispensing opening and a bottom of the container body and defining a funnel stowage location;

(b) top and bottom physical attachments for releasably securing a funnel to the funnel stowage location, the funnel adapted to be removed from the funnel stowage location and moved to a flowable material receiving location physically-separate from and proximate to the dispensing opening in the container body; and (c) a wiping sheet positioned in the funnel and adapted to be removed from the funnel and used to wipe and absorb the flowable material.

11. A container according to claim 10, wherein the top physical attachment comprises a loop carried by the funnel proximate the top opening of the funnel and adapted to extend over the dispensing opening in the container body and retain a top end of the funnel against the funnel stowage location.

12. A container according to claim 10, wherein the bottom physical attachment comprises a seat formed in the wall of the container body proximate the bottom opening of the funnel and shaped and sized to releasably retain a bottom end of the funnel against the funnel stowage location.

13. A container according to claim 10, wherein the funnel is plastic.

14. A container according to claim 10, wherein the wiping sheet positioned in the funnel is rolled into a tubular shape.

15. A container according to claim 10, and including a removable cover positioned on the top opening of the funnel.

* * * * *